US008753111B2

(12) United States Patent
Nolan

(10) Patent No.: US 8,753,111 B2
(45) Date of Patent: Jun. 17, 2014

(54) SWIRL COMBUSTION AIR FUEL TORCH

(75) Inventor: Todd R Nolan, Suwanee, GA (US)

(73) Assignee: Lincoln Global, Inc., City of Industry, CA (US)

( * ) Notice: Subject to any disclaimer, the term of this patent is extended or adjusted under 35 U.S.C. 154(b) by 127 days.

(21) Appl. No.: 13/267,678

(22) Filed: Oct. 6, 2011

(65) Prior Publication Data

US 2013/0089825 A1 Apr. 11, 2013

(51) Int. Cl.

| | |
|---|---|
| ***F23C 7/00*** | (2006.01) |
| ***F23D 14/38*** | (2006.01) |
| ***F23D 14/52*** | (2006.01) |
| *F23D 14/40* | (2006.01) |
| *F23D 14/42* | (2006.01) |
| *F23D 14/62* | (2006.01) |
| *F23D 14/64* | (2006.01) |

(52) U.S. Cl.

CPC ..... *F23D 14/38* (2013.01); *F23D 14/52* (2013.01); *F23D 14/40* (2013.01); *F23D 14/42* (2013.01); *F23D 14/62* (2013.01); *F23D 14/64* (2013.01)

USPC ..... 431/344; 431/345; 431/127; 431/254; 431/255; 431/350; 239/463; 239/461

(58) Field of Classification Search

USPC ..... 431/344, 345, 127

See application file for complete search history.

(56) References Cited

U.S. PATENT DOCUMENTS

| | | | | |
|---|---|---|---|---|
| 1,961,751 | A * | 6/1934 | Feyling | 431/349 |
| 2,513,523 | A * | 7/1950 | Schafer | 239/419.5 |
| 2,631,659 | A * | 3/1953 | Wright | 48/180.1 |
| 2,720,257 | A * | 10/1955 | Lynes | 431/353 |
| 2,888,979 | A * | 6/1959 | Lindgren | 239/337 |
| 3,600,119 | A * | 8/1971 | Abbott, Jr. | 431/67 |
| 3,736,093 | A * | 5/1973 | Bowman et al. | 431/89 |
| 3,768,962 | A * | 10/1973 | Baranowski, Jr. | 431/353 |
| 4,013,395 | A * | 3/1977 | Wormser | 431/9 |
| 4,255,124 | A * | 3/1981 | Baranowski, Jr. | 431/353 |
| 4,639,215 | A * | 1/1987 | Armstrong | 431/354 |
| 4,666,399 | A * | 5/1987 | Nelson | 431/264 |
| 4,732,559 | A * | 3/1988 | Pearl et al. | 431/346 |
| 4,744,748 | A * | 5/1988 | Raines et al. | 431/353 |
| 4,846,670 | A * | 7/1989 | Pearl et al. | 431/346 |
| 4,886,447 | A * | 12/1989 | Goss | 431/353 |
| 5,286,189 | A * | 2/1994 | Goss | 431/255 |
| 5,470,226 | A * | 11/1995 | Pearl et al. | 431/255 |
| 2004/0166454 | A1* | 8/2004 | Zwicker | 431/263 |
| 2008/0274434 | A1* | 11/2008 | Burdsall et al. | 431/344 |
| 2012/0074244 | A1* | 3/2012 | Burdsall et al. | 239/581.1 |

OTHER PUBLICATIONS

TurboTorch HVAC/R and Plumbing Equipment Catalog. Catalog [online] Thermadyne Industries, Inc., 2007 [retrieved on Apr. 5, 2013]. Retrieved from the internet <URL: http://www.rsd.net/fx/assets/prod/757.pdf>.*

* cited by examiner

*Primary Examiner* — Kenneth Rinehart

*Assistant Examiner* — Sharla Magana

(74) *Attorney, Agent, or Firm* — Perkins Coie LLP

(57) ABSTRACT

A torch is provided having a tube having an inside diameter, a body and an orifice tip having a bore, where the diameter of the bore of the orifice tip and the inside diameter of the tube have a particular ratio based upon the type of fuel used for the operation.

20 Claims, 2 Drawing Sheets

SWIRL COMBUSTION AIR FUEL TORCH

BACKGROUND OF THE INVENTION

1. Field of the Invention

Devices, systems, and methods consistent with the present invention relate to a torch and more particularly to an improved swirl combustion air fuel torch.

2. Description of the Related Art

Gas torches are used to combine air with a combustible fuel. The torches attempt to combine the air with the fuel to create an appropriate mixture ratio to provide a heating or cutting flame which is then used to heat or cut through materials such as metal. However, because of various factors, such as different fuel types and densities, flow rates, etc. it can be difficult to provide a torch which optimizes the fuel/air mixture to provide a stable and optimal flame.

BRIEF SUMMARY OF THE INVENTION

An exemplary embodiment of the present invention is a torch, having a torch body having an upstream cavity, a mixture cavity and a tube connection portion downstream of the mixture cavity. The mixture cavity has a plurality of conical bores through a sidewall of the mixture cavity to permit a flow of air into the mixture cavity, and the tube connection portion has a bore to receive a flow from the mixture cavity and direct the flow to an exit of said tube connection portion. A tip orifice structure is inserted into the upstream cavity and the tip orifice structure has a bore through a center thereof. The bore has a first diameter and the bore directs a fuel to the mixture cavity. A tube is coupled to the tube connection portion which receives the flow from the tube connection portion, and has a inner diameter. The tube delivers the flow to a flame and the the ratio of the first diameter to the inner diameter of the tube is in the range of 5 to 7% for acetylene torches and 2 to 3% for propane and propylene torches.

BRIEF DESCRIPTION OF THE DRAWINGS

The above and/or other aspects of the invention will be more apparent by describing in detail exemplary embodiments of the invention with reference to the accompanying drawings, in which.

DETAILED DESCRIPTION OF EXEMPLARY EMBODIMENTS

Figure 1A:
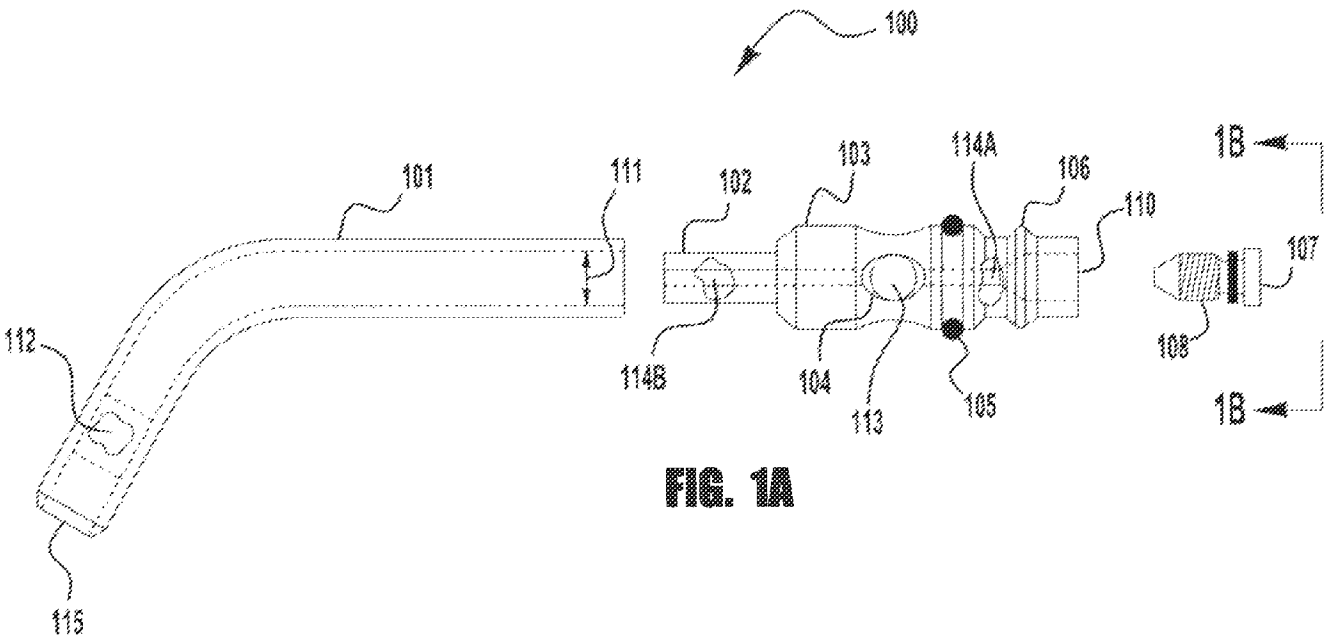
FIG. 1A illustrates a diagrammatical representation of a torch in accordance with an exemplary embodiment of the present invention.
Figure 1B:
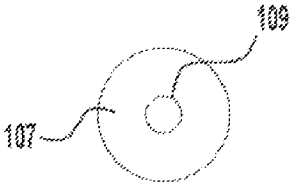
FIG. 1B illustrates a diagrammatical representation of a view of a tip orifice in accordance with an exemplary embodiment of the present invention.

Exemplary embodiments of the invention will now be described below by reference to the attached Figures. The described exemplary embodiments are intended to assist the understanding of the invention, and are not intended to limit the scope of the invention in any way. Like reference numerals refer to like elements throughout.

FIG. 1A/1B is a diagrammatical representation of a torch 100 in accordance with an exemplary embodiment of the present invention. The torch 100 is made up of a number of components, primarily including a tip tube 101; a torch body 103, a tip orifice 107, and a swirl tip insert 112. Each of these components will be discussed in turn.

The tip orifice 107 is a brass insert which is to be inserted into a cavity 110 in the torch body 103. The orifice 107 can be made of a metallic material such as brass. The tip orifice 107 can also have a threaded section 108 which allows the orifice 107 to be securely inserted into the body 103. Through the centerline of the tip orifice 107 an inlet bore 109 is provided. The bore 109 has a constant diameter along its length and a cylindrical shape. Based on the application for the torch 100 the bore can have different diameters. That is, for some operations a smaller bore 109 is needed while for other operations a larger bore 109 is needed. The bore should be made as smooth as possible so as to ensure smooth gas flow through the bore 109. In exemplary embodiments, the bore can have a diameter in the range of 0.007 to 0.04 inches.

The body 103 can also be made from brass and has a cavity 110 which allows for the proper seating of the tip orifice 107. This seating should be such that no gas can escape from the connection. An o-ring can be used to ensure an adequate seal is provided. Along the centerline of the body 103 is a bore 114 which allows for the flow of gas from the tip orifice 107 to pass through the body 103 to an inner cavity 113 in the body 103 and into the tube 101. The bore 114 is comprised of an upstream portion 114A and a downstream portion 114B which are separated by the cavity 113. In an exemplary embodiment of the present invention, the upstream portion 114A has a first diameter and the downstream portion 114B has a second diameter which is larger than the first diameter. In an exemplary embodiment, the upstream portion 114A has a diameter which is the same as the diameter of the bore 109 in the tip orifice. In a further exemplary embodiment, the upstream portion 114A has a diameter which is slightly larger than that of the bore 109. However, the diameter differential should not be so much as to adversely affect the flow of gas from the bore 109 into the cavity 113.

In exemplary embodiments of the present invention used with acetylene fuel the bore 109 has a constant diameter in the range of 0.01 to 0.04 inches. In exemplary embodiments of the present invention used with either propane or propylene fuel the bore 109 has a constant diameter in the range of 0.007 to 0.02 inches.

In another exemplary embodiment, the cavity 113 is sized such that the bore 109 of the tip orifice 107 directly delivers the fuel to the cavity 113, in that there is no upstream portion 114A of the bore 114. Rather the cavities 110 and 113 are sized such that the downstream tip of the tip orifice 107 directly contacts the cavity 113.

The body 103 has a first connection end 106 which connects to a gas supply line (not shown) which is typically connected to a gas supply source (also not shown). The first connection 106 can be of any known type of connection to allow for the body 103 to be properly secured to a gas supply line. In an exemplary embodiment of the present invention, the connection 106 is a "quick-type" connection end which allows for the quick release and connection of the body. Such a connection uses a slidable collar and a pressure fitting such that when the end 106 is inserted into the supply line a hermetic seal is provided to prevent gas from flowing through the joint. Such a connection type is generally known and need not be described in detail herein. On the sides of the body 103 are at least four conically shape bores 104 which all extend from an outer surface of the body 103 to an inner cavity 113. In the embodiment in which there are four bores 104, they are each positioned 90 degrees from each other radially. This inner cavity 113 couples the upstream and downstream portions 114A/114B of the bore 114 with the conically shaped bores 104 on the sides of the body 103.

Figure 2:
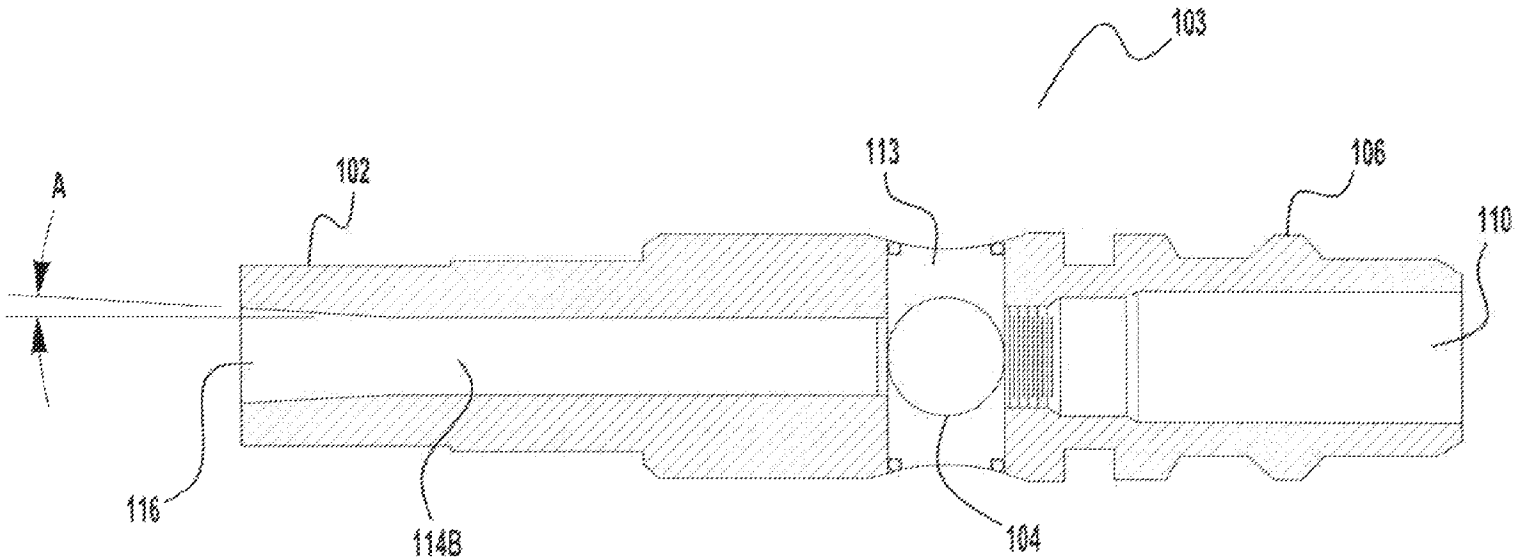
FIG. 2 illustrates a diagrammatical representation of a torch body in accordance with an exemplary embodiment of the present invention.

FIG. 2 depicts a cross-section of a body 103 in accordance with an exemplary embodiment of the present invention. In the embodiment shown there is no upstream portion 114A of the bore 114 (as discussed above), but the cavity 110 is directly coupled to the cavity 113. Also shown in this embodiment is an expansion area 116 located at the exit of the tube connection portion 102. The expansion area 116 allows the mixture to expand gradually as it approaches the tube 101 so that the transition from the body 103 to the tube 101 does not create a significant disruption in the flow, such as with eddy currents, or the like. The expansion area 116 is formed by angling the inner surface of the downstream portion 114B so as to create a conical exit. In an exemplary embodiment of the present invention, the angle A of the conical section is in the range of 3 to 30°. It has been discovered that an angle in the stated range provides optimal performance in transition from the body 103 to the tube 101.

During use of the torch 100, a fuel gas is provided from a source through a hose to the body 103. The gas then flows through the bore 109 in the tip orifice 107 into the upstream portion 114A of the bore 114 in the body 103. As the gas then flows into the cavity 113 towards the downstream portion 114B of the bore 114 it creates a venturi effect at the conical bores 104 which causes the atmosphere to be drawn in through the conical bores and into the cavity 113. Thus, in the cavity 113 a mixture of fuel and atmosphere is created. This mixture then passes down through the downstream portion 114B of the bore 114 and into the tube 101. The body 103 has a tube connection portion 102 which allows for the connection between the body 103 and the tube 101. This connection can be made in any number of ways, including a friction fit, a threaded connection, or the like. However, the connection should be also hermetic such that the mixture of fuel and atmosphere does not escape from the connection point. The downstream portion 1148 should have a sufficient diameter to deliver the combined volume of the atmosphere and fuel without restricting the flow of the mixture. All of the bores and cavities in the body are to be as smooth as possible so as to provide smooth surfaces for fuel and atmosphere flow.

The tube 101 can be made of a stainless steel material, as well as other metals which are capable of withstanding high temperatures. The tube 101 has an inside diameter ID which is selected for the appropriate operation. That is, a higher flow rate of mixture will require a larger diameter ID. The inside diameter ID is to be constant along the length of the tube 101 and should be a smooth surface to provide for optimal flow. The diameter ID can be in the range of 0.2 to 0.7 inches.

As shown in FIG. 1A the tube 101 can be bent. However, embodiments of the present invention are not limited to this, and can have a straight configuration as well. To the extent the tube 101 is bent the bend should not be so dramatic so as to adversely affect the flow of the mixture through the tube 101 or significantly affect the diameter ID of the tube 101. Within the tube 101, near the end 115, a swirl insert 112 is provided. The swirl insert 112 can be made of brass, stainless steel or similar materials and has a series of helical channels or flutes in it (not shown) which swirl the mixture of gas and atmosphere prior to the mixture exiting the tip 115. In exemplary embodiments of the present invention, the number of channels/flutes can be in the range of 3 to 5. The channels/flutes should be sized such that they do not result in any appreciable choking of the flow of the mixture through the tube 101. Further, the helical pattern of the flutes should be such that the fuel and atmosphere is sufficiently mixed for optimal combustion after the mixture exits the tip 115. The insert 112 can have an outside diameter which allows it to be press fit or friction fit into the tube 101. Other means to secure the insert 112 can also be employed.

It has been discovered, unexpectedly, that the ratio of the diameter of the bore 109 in the tip orifice 107 to the inside diameter ID of the tube 101 is important to the optimal operation of the torch 100. This ratio has not been previously appreciated or understood. Furthermore, it has been discovered that this ratio is dependant upon the type of fuel being employed for the operation. For example, this ratio depends on whether or not the fuel used is acetylene or propane and propylene. This will be explained more fully below.

It has been discovered that, in exemplary embodiments of the invention, if the torch 100 is to be used with acetylene fuel the ratio of the bore 109 diameter to the inside diameter of the tube should be in the range of 5 to 7%. In further exemplary embodiments to be used with acetylene it has been discovered that the ratio should be in the range of 5.4 to 6.6%. However, for torches to be used with either propane or propylene fuel exemplary embodiments are to have a ratio in the range of 2 to 3%. In further exemplary embodiments using propane or propylene the ratio is in the range of 2.5 to 3%. It has been discovered that these ratios, for the appropriate fuel, provide surprisingly improved performance. It has also been discovered that the ratio is dependant on the type of fuel to be used, as indicated above.

For example, if an exemplary torch 100 is to be used with acetylene fuel and the inside diameter ID of the tube 101 is ¼", the diameter of the bore 109 in the tip orifice should be in the range of 0.0125" to 0.0175" (5 to 7%). However, if the exemplary torch is to be used with propane or propylene the diameter of the bore 109 is to be in the range of 0.005" to 0.0075" (2 to 3%). By maintaining these respective ratios, optimal performance can be achieved for the torch.

With these ratios, exemplary embodiments of the torch 100, used with acetylene, can provide overall mixture flow rates in the range of 2 to 30 SCFH (standard cubic foot per hour) at a fuel pressure of 14 PSI, while still provide an optimal flame. Similarly, in exemplary embodiments used with propane or propylene a flow rate in the range of 2 to 12 SCFH can be achieved at a fuel pressure of 28 PSI, while still providing an optimal flame. Of course, it is understood that larger flow rates are achieved by using a larger diameter tube 101 and bore 109. The ratios discussed above allow for an optimal flow and mixing of the atmosphere (e.g., air) with the fuel to achieve an optimal flame.

While the invention has been particularly shown and described with reference to exemplary embodiments thereof, the invention is not limited to these embodiments. It will be understood by those of ordinary skill in the art that various changes in form and details may be made therein without departing from the spirit and scope of the invention as defined by the following claims.

What is claimed is:

1. A torch, comprising:

a torch body having;

an upstream cavity, a channel disposed downstream of said upstream cavity, a mixture cavity separating said channel into a first channel and a second channel, said first channel disposed to receive a flow from said upstream cavity and said mixture cavity has a plurality of conical bores through a sidewall of said mixture cavity to permit a flow of air into said mixture cavity, and a tube connection portion downstream of said second channel, said tube connection portion has a bore to receive a flow from said second channel and direct said flow from said second channel to an exit of said tube connection portion;

a tip orifice structure inserted into said upstream cavity, said tip Orifice structure having a bore through is center thereof, said bore having a first diameter and where said bore directs a fuel to said mixture cavity via said first channel; and a tube coupled to said tube connection portion which receives said flow from said tube connection portion, and has an inner diameter, where said tube delivers said flow from said tube connection portion to a flame at an exit of said tube;

wherein a diameter of said second channel is greater than a diameter of said first channel, wherein the ratio of said first diameter to said inner diameter of said tube is in the range of 5 to 7%, wherein said fuel is acetylene, and wherein said bore in said tube connection portion has an expansion cavity in a downstream portion of said bore in said tube connection portion.

2. The torch of claim 1, wherein said ratio is in the range of 5.4 to 6.6%.

3. The torch of claim 1, wherein said expansion cavity comprises an angled surface having an angle in the range of 3 to 30 degrees.

4. The torch of claim 1, further comprising a swirl insert which is positioned in said tube proximate to said flame.

5. The torch of claim 1, wherein said diameter of said first channel is equal to said first diameter.

6. The torch of claim 1, wherein said diameter of said first channel is larger than said first diameter.

7. The torch of claim 1, wherein said first diameter is in the range of 0.01 to 0.04 inches and said inside diameter of said tube is in the range of 0.2 to 0.7 inches.

8. The torch of claim 1, wherein the number of said plurality of conical bores is in the range of 3 to 5.

9. The torch of claim 1, wherein said torch can provide a flow rate of 2 to 30 SCFH at an acetylene fuel pressure of 14 PSI.

10. A torch, comprising:

a torch body having;

an upstream cavity, a channel disposed downstream of said upstream cavity, a mixture cavity separating said channel into a first channel and a second channel, said first channel disposed to receive is flow from said upstream cavity and said mixture cavity has as plurality of conical bores through a sidewall of said mixture cavity to permit a flow of air into said mixture cavity, and a tube connection portion downstream of said second channel, said tube connection portion has a bore to receive a flow from said second channel and direct said flow from said second channel to an exit of said tube connection portion;

a tip orifice structure inserted into said upstream cavity, said tip orifice structure having a bore through a center thereof, said bore having a first diameter and where said bore directs a fuel to said mixture cavity via said first channel; and a tube coupled to said tube connection portion which receives said flow from said tube connection portion, and has an inner diameter, Where said tube delivers said flow from said tube connection portion to a flame at an exit of said tube;

wherein a diameter of said second channel is greater than a diameter of said first channel, wherein the ratio of said first diameter to said inner diameter of said tube is in the range of 2 to 3%, wherein said fuel is either propane or propylene, and wherein said bore in said tube connection portion has an expansion cavity in a downstream portion of said bore in said tube connection portion.

11. The torch of claim 10, wherein said ratio is in the range 2.5 to 3%.

12. The torch of claim 10, wherein said expansion cavity comprises an angled surface having an angle in the range of 3 to 30 degrees.

13. The torch of claim 10, further comprising a swirl insert which is positioned in said tube proximate to said flame.

14. The torch of claim 10, wherein said diameter of said first channel is equal to said first diameter.

15. The torch of claim 10, wherein said diameter of said first channel is larger than said first diameter.

16. The torch of claim 10, wherein said first diameter is in the range of 0.007 to 0.02 inches and said inside diameter of said tube is in the range of 0.2 to 0.7 inches.

17. The torch of claim 10, wherein the number of said plurality of conical bores is in the range of 3 to 5.

18. The torch of claim 10, wherein said torch can provide a flow rate of 2 to 12 SCFH at a fuel pressure of 28 PSI.

19. A torch, comprising:

a torch body having;

an upstream cavity, a channel disposed downstream of said upstream cavity, a mixture cavity separating said channel into a first channel and a second channel, said first channel disposed to receive a flow from said upstream cavity and said mixture cavity has a plurality of conical bores through a sidewall of said mixture cavity to permit a flow of air into said mixture cavity, and a tube connection portion downstream of said second channel, said tube connection portion has a bore to receive a flow from said second channel and direct said flow from said second channel to an exit of said tube connection portion;

tip orifice structure inserted into said upstream cavity, said tip orifice structure having a bore through a center thereof, said bore having a first diameter and where said bore directs a fuel to said mixture cavity via said first channel; and a tube coupled to said tube connection portion which receives said flow from said tube connection portion, and has an inner diameter, where said tube delivers said flow from said tube connection portion to a flame at an exit of said tube;

wherein to diameter of said second channel is greater than as diameter of said first channel, wherein the ratio of said first diameter to said inner diameter of said tube is in the range of 5 to 7%, wherein said fuel is acetylene, and wherein said diameter of said first channel is equal to said first diameter.

20. A torch, comprising:

a torch body having;

an upstream cavity, a channel disposed downstream of said upstream cavity, a mixture cavity separating said channel into a first channel and a second channel, said first channel disposed to receive a flow from said upstream cavity and said mixture cavity has a plurality of conical bores through a sidewall of said mixture cavity to permit a flow of air into said mixture cavity, and a tube connection portion downstream of said second channel said tube connection portion has a bore to receive a flow from said second channel and direct said flow from said second channel to an exit of said tube connection portion;

a tip orifice structure inserted into said upstream cavity, said tip orifice structure having a bore through a center thereof, bore having a first diameter and where said bore directs a fuel to said mixture cavity via said first channel; and a tube coupled to said tube connection portion which receives said flow from said tube connection portion, and has an inner diameter, where said tube delivers said flow from said tube connection portion to a lame at an exit of said tube;

wherein a diameter of said second channel is greater than a diameter of said first channel, wherein the ratio of said first diameter to said inner diameter of said tube is in the range of 2 to 1%, wherein said fuel is either propane or propylene, and wherein said diameter of said first channel is equal to said first diameter.

* * * * *